United States Patent [19]

Okuyama

[11] Patent Number: 4,463,662

[45] Date of Patent: Aug. 7, 1984

[54] COMPACT ROTARY POWER CYLINDER

[75] Inventor: Yukio Okuyama, Tokyo, Japan

[73] Assignee: Aoki Kabushiki Kaisha, Tokyo, Japan

[21] Appl. No.: 350,338

[22] Filed: Feb. 19, 1982

[51] Int. Cl.[3] ..... F01B 7/02

[52] U.S. Cl. ..... 92/69 R; 92/75; 92/136; 92/138

[58] Field of Search ..... 92/69 R, 50, 75, 136, 92/138, 248; 91/418

[56] References Cited

U.S. PATENT DOCUMENTS

| | | | |
|---|---|---|---|
| 3,672,260 | 6/1972 | Gachot et al. | 92/69 R |
| 3,982,725 | 9/1976 | Clark | 92/69 R |
| 4,203,351 | 5/1980 | Schwind | 92/69 R |

*Primary Examiner*—Robert E. Garrett

*Assistant Examiner*—Scott L. Moritz

*Attorney, Agent, or Firm*—Irving M. Weiner; Pamela S. Burt; Anthony L. Cupoli

[57] ABSTRACT

A compact rotary power cylinder including a pair of pistons fitted in a cylinder housing, separating the housing into a first chamber and a pair of second chambers, so as to be reciprocally movable when a pressure impact is supplied selectively to the first and second chambers, and a torque stem provided through the housing perpendicularly to the reciprocal motion of the pistons so as to be rotatable in response to the reciprocal motion, in which a pair of connecting members are provided between the stem and the pistons so as to be movable in a radial direction of the stem.

A relatively large breakaway torque is achieved with such structure.

5 Claims, 7 Drawing Figures

COMPACT ROTARY POWER CYLINDER

BACKGROUND OF THE INVENTION

1. Field of the Invention

The present invention relates to a compact rotary power cylinder. More particularly, the present invention relates to a compact rotary power cylinder comprising a pair of pistons reciprocally movable when a pressure impact is applied thereto and a torque stem rotatable to provide a torque in response to the reciprocal motion of the pair of pistons, wherein an improved connection is provided between the pistons and stem so as to render the power cylinder substantially compact as a whole while achieving a preferable torque characteristic.

2. Description of Relevant Art

The prior art to which the present invention is directed includes the art of compact rotary power cylinders being of a type in which a pair of pistons are fitted in a cylinder housing, separating such housing into a first chamber and a pair of second chambers, so as to be reciprocally movable when a pressure impact is supplied selectively to the first and second chambers, and a torque stem is provided through the cylinder housing perpendicularly to a reciprocal motion of the pistons so as to be rotatable in response to the reciprocal motion. Power cylinders of this type are generally used as accessory elements for actuation of final controls in process plants, typically to operate control valves which require a fast operation, such as when opening and closing a shut-off valve for filling beer or the like in a container. In such rotary power cylinders, therefore, it is essential that the overall size be minimized and the configuration be compact.

To meet such requirement there have been developed compact rotary power cylinders of the above-mentioned type in which an improvement is made such that the stem is operatively connected to the paired pistons with a pair of pivotable links provided therebetween.

With reference to FIG. 7 of the accompanying drawings, there is shown a horizontal sectional view of the aforesaid improved type of conventional compact rotary power cylinder.

Referring to FIG. 7, the conventional compact rotary power cylinder comprises a horizontal cylinder housing 40 having a pair of pistons 41, 42 slidably fitted therein and a vertical torque stem 43 rotatably provided therethrough. Housing 40 is thus separated by pistons 41, 42 into an intermediate chamber A and left and right chambers B, C. By selectively supplying a pressure impact into chambers A, B and C, pistons 41, 42 are reciprocally movable. In chamber A there is provided a link 44 pivotally connected on one side to stem 43 by a pin **44*a* and on the other side to piston 41 by another pin 44*b*. Likewise, there is provided another link 45 pivotally connected to stem 43 and piston 42 by pins 45*a*, 45*b***, respectively.

In the above arrangement, pivots **44*a*, 45*a* are disposed symmetrically with respect to the axis of stem 43 and, when the pressure impact is supplied to chamber A, travel from their original positions along respective arcuate paths to their final positions 44*a*′, 45*a*′, thereby rotating stem 43. Because of the overlapping provided between links 44, 45, the overall length of housing 40** is substantially reduced.

However, such arrangement has an attendant problem inasmuch as the original points of pivots **44*a*, 45 *a* are required to be angularly displaced toward the opposite direction relative to their final positions 44*a*′, 45*a*′ to achieve the overlapping between links 44, 45**, thus resulting in a relatively small breakaway torque, which is disadvantageous in view of the fact that most final controls require relatively large breakaway torques.

Further, in the above arrangement, pistons 41, 42 are supported by pivotable links 44, 45 and are not sufficiently stable during their reciprocal motion including breakaway, thus adversely affecting the torque output characteristic of stem 43.

SUMMARY OF THE INVENTION

The present invention effectively overcomes the above described problems attendant conventional compact rotary power cylinder arrangements.

The present invention provides an improvement in a compact rotary power cylinder including a pair of pistons fitted in a cylinder housing, the pistons separating the housing into a first chamber and a pair of second chambers and being capable of a reciprocal motion when a pressure impulse is supplied selectively to the first and second chambers. A torque stem is provided through the housing perpendicularly to the reciprocal motion, the stem being rotatable in response to the reciprocal motion. A pair of connecting members is provided between the stem and either of the pistons so as to be movable in a radial direction of the stem.

An object of the present invention is to provide a compact rotary power cylinder as described above, in which the pistons have respective piston supports secured thereto.

According to the present invention, the effective distance from the axis of the stem to the acting point of a force due to the reciprocal motion of each piston becomes relatively long even at the breakaway points, thus providing a substantially large breakaway torque.

A further advantage according to the present invention resides in improvement in the stability of the reciprocal piston motion, realized by providing the piston supports secured to the respective pistons, thus substantially improving the torque output characteristics of the stem.

Other objects and advantages of the present invention will become apparent from the following detailed description when read in conjunction with the accompanying drawings.

DETAILED DESCRIPTION

Figure 1:
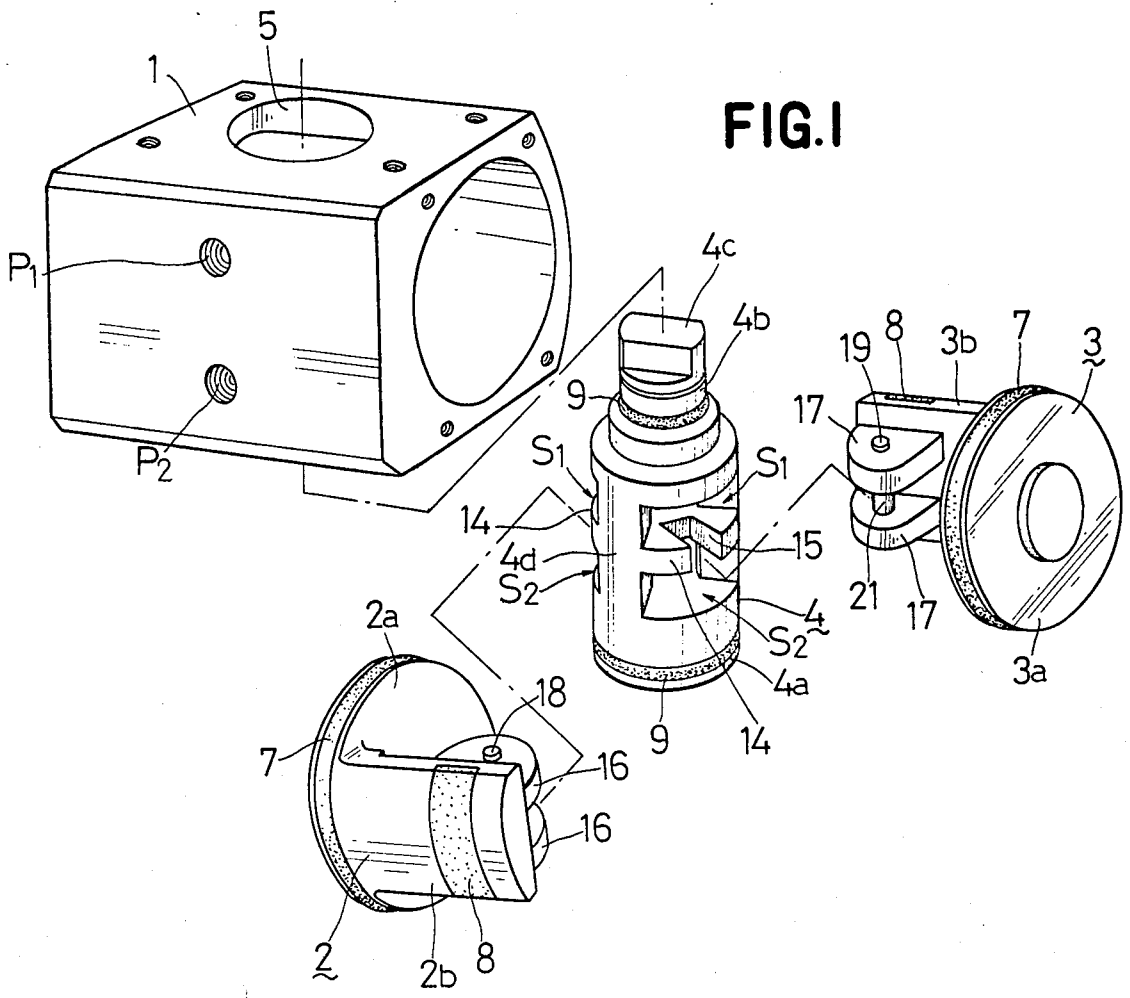
FIG. 1 is an exploded perspective view of a compact rotary power cylinder according to an embodiment of the present invention.

Referring first to the embodiment of the present invention shown in FIGS. 1–5, the compact rotary power cylinder comprises a horizontal cylinder housing 1, a pair of pistons 2, 3 horizontally accommodated therein from the left and right, and a torque stem 4 of a substantially cylindrical configuration provided to extend vertically through housing 1. Preferably, these principal components may be fabricated of an aluminum alloy casting. Housing 1 has at its longitudinally and laterally intermediate portion a top hole 5 of a relatively smaller diameter and a bottom hole 6 of a relatively larger diameter formed vertically through top and bottom walls of housing 1, respectively. On the other hand, stem 4 has a larger diameter lower portion 4*a* fitted rotatably and in a pressure-tight manner in bottom hole 6, a smaller diameter upper portion 4*b* fitted likewise in top hole 5, and a top projection 4*c* to be secured or operatively connected for torque transmission to an operating member (not shown) of final control members such as a rotary stem of control valves.

The pair of pistons 2, 3 are provided with respective disc-like piston heads 2*a*, 3*a* fitted slidably and in a pressure-tight manner in a cylindrical inner wall of housing 1 and respectively integrally provided on the inside thereof with a longitudinal and substantially vertically oriented plate-like piston support 2*b*, 3*b* which supports 2*b*, 3*b* are flat on the inside and arcuate on the outside so as to be flush with the circumference of associated piston heads 2*a*, 3*a*, so that when viewed from above a pair of substantially L-shaped configurations are formed symmetrically with respect to the axis of stem 4.

For necessary pressure-tight sealing, a pair of O-rings 7 are respectively fitted on each piston head 2*a*, 3*a* and similar smaller and larger O-rings 9 on smaller and larger diameter portions 4*a*, 4*b* of stem 4, respectively. Further, in order to keep the breakaway friction to a minimum, there is provided an anti-friction band 8 fabricated of a teflon or similar material along the arcuate outside width of each piston support 2*b*, 3*b*, which bands 8 slide together with associated piston heads 2*a*, 3*a* along the inner wall of housing 1.

Figure 2:
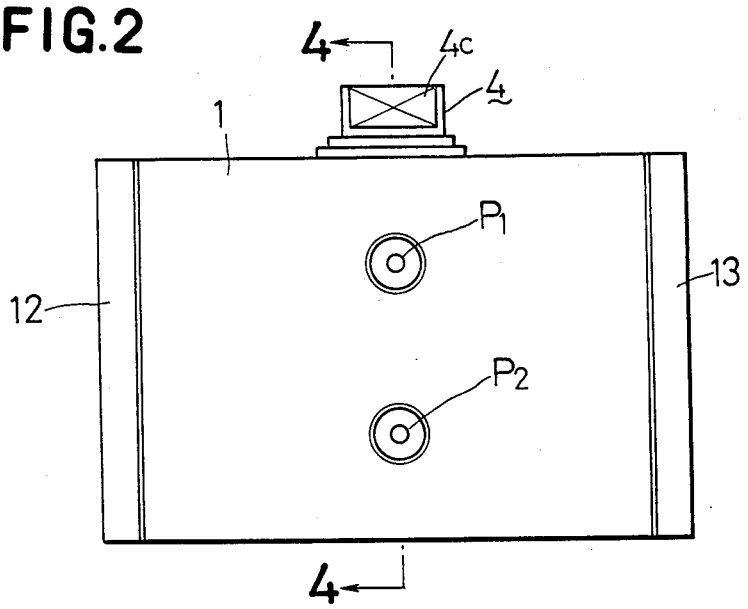
FIG. 2 is a side elevational view of the compact rotary power cylinder as assembled.
Figure 3:
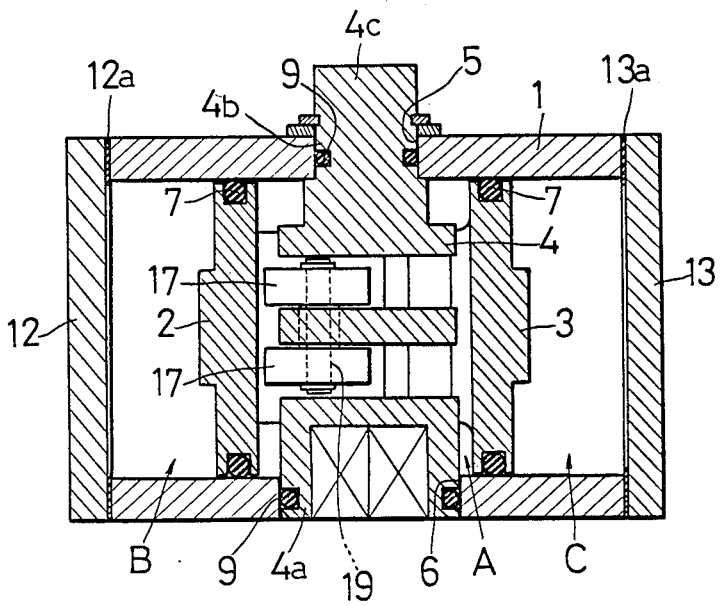
FIG. 3 is a longitudinal sectional view of the power cylinder of FIG. 2.
Figure 5:
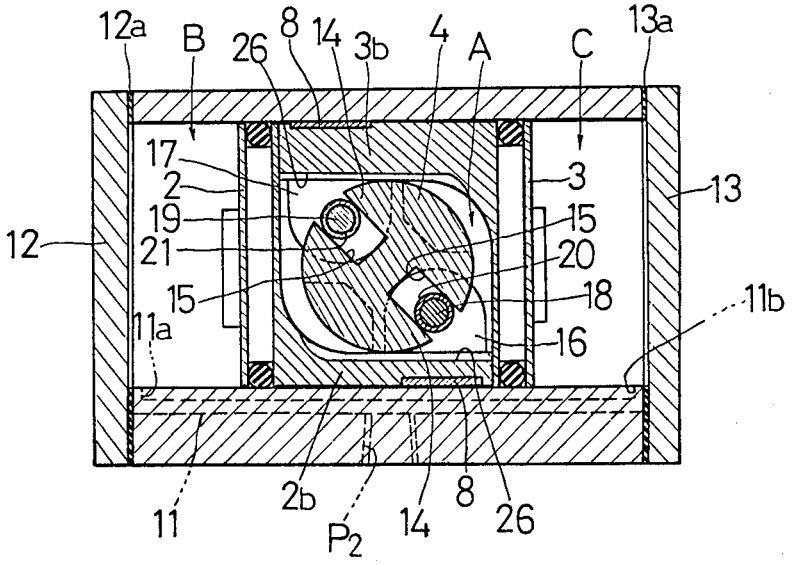
FIG. 5 is a sectional view taken along the line 5—5 of FIG. 4.

As shown in FIGS. 2, 3 and 5, housing 1 has a pair of end plates 12, 13 secured through respective gaskets 12*a*, 13*a* to, and for necessary pressure-tight sealing at, either end of the cylindrical inner wall of housing 1. Accordingly, there are defined three pressure-tight chambers in housing 1, i.e., an intermediate first chamber A between piston heads 2*a*, 3*a*, a left second chamber B between end plate 12 and piston head 2*a*, and a right second chamber C between piston head 3*a* and end plate 13. As shown, chamber A has stem 4 vertically extending therethrough.

Figure 4:
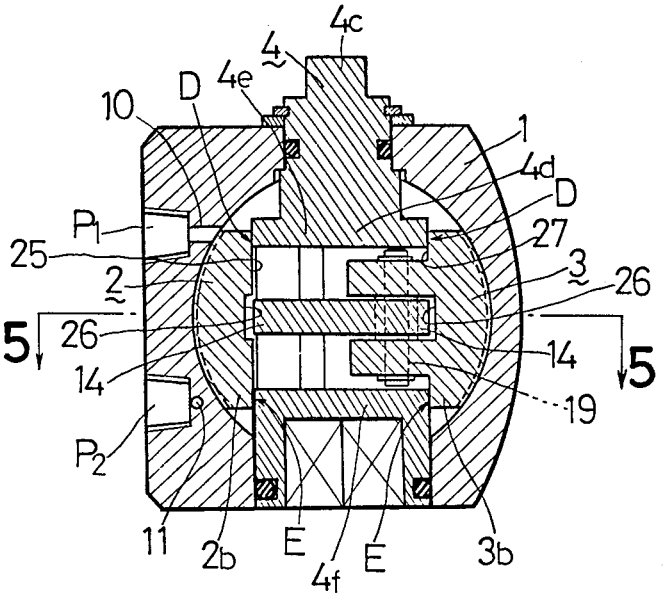
FIG. 4 is a sectional view taken substantially along the line 4—4 of FIG. 2.

Housing 1 is formed at the intermediate portion thereof with a pair of impact ports $P_1$, $P_2$ which are provided for the supply and relief of pressure impact as a control signal from a controller (not shown) such as a three-way solenoid valve. In this embodiment, there is formed an upper impact port $P_1$, communicated through a passage 10 with intermediate chamber A, as shown in FIG. 4, and a lower impact port $P_2$ connected through passage 11 with a left and right branches 11*a*, 11*b* to left and right chambers B, C, respectively, as shown in FIG. 5.

Referring in particular to FIG. 1, stem 4 has the axially intermediate portion 4*d* thereof, which comprises the upper part of larger diameter portion 4*a*, formed with axially spaced apart pairs of radially inwardly cut upper recesses $S_1$ and lower recesses $S_2$, with a pair of fan-like flat portions 14 defined therebetween, all in a symmetrical relation with respect to the axis of stem 4. Respective pairs of upper recesses $S_1$ are cut to a depth so as to communicate with each other, thus directly joining the pair of fan-like portions 14 with each other, to permit a compact design while rendering sufficiently wide respective spaces defined by recesses $S_1$, $S_2$ for accommodation of a pair of fixing members, such as brackets 16, 17. Further, each fan-like portion 14 is forked so as to have a slot 15 opening vertically and outwardly with both sides thereof being substantially relatively parallel.

On the other hand, to the flat inside of piston support 2*b*, there are integrally secured a pair of brackets 16 with an engagement member, such as a substantially vertical shaft 18, extending therebetween. The shaft 18 is prevented from falling out at both ends thereof in a conventional manner such as by the use of a slit pin, and a collar 20 is rotatably fitted on shaft 18 between brackets 16.

Likewise, another pair of brackets 17 is secured to the inside of piston support 3*b* and has another engagement member, such as a shaft 19, extending therebetween. Another collar 21 is rotatably fitted thereon.

With the above-described construction, the pair of pistons 2, 3 are arranged such that the respective pairs of brackets 16, 17 are freely accommodated in corresponding upper and lower recesses $S_1$, $S_2$ of stem 4 with respective collars 18, 19 freely fitted in corresponding slots 15 of fan-like portions 14 of stem 4, whereby pistons 2, 3 are slidable reciprocally along the inner wall of housing 1 and symmetrically with respect to the axis of stem 4.

Further, upper larger diameter portion 4*d* of stem 4 has the uppermost portion 4*e* and lowermost portion 4*f* thereof in slidable contact at points D, E with the respective flat inside surfaces of piston supports 2*b*, 3*b*. The inside surfaces of piston supports 2*b*, 3*b* have respective flat portions 25, 27 in contact with the portions 4*e*, 4*f* of stem 4, while each of the flat portions 25, 27 is formed with a recess 26 to provide an allowance for the movement of fan-like portions 14 of stem 4.

The operation of the above-described compact rotary power cylinder will be explained hereinafter.

In the above embodiment, as will be understood from FIG. 5, when the pressure impact is supplied through part $P_1$ and passage 10 to intermediate chamber A, pistons 2, 3 are forced to move outwardly toward their final positions together with their shafts 18, 19 and collars 20, 21 which in turn cause stem 4 to rotate clockwise in FIG. 5 while moving along the depth of corresponding slots 15. On the contrary, when the pressure impact is supplied through port $P_2$, passage 11 and branches 11*a*, 11*b* to the left and right chambers B, C, pistons 2, 3 are forced to return to their initial positions, thereby rotating stem 4 counterclockwise.

According to the initial and final positions of pistons 2, 3, stem 4 has the initial and final positions thereof angularly spaced apart from each other by a predetermined angle which is 90° in most actual cases and in this embodiment, while such angle may have another value as circumstances require. The initial position or 0° position and final position or 90° position of stem 4 are selected to be substantially symmetrical with respect to an imaginary plane including the axis of stem 4 and perpendicular to that of housing 1, thus achieving the longest possible overlapping between piston supports 2*b*, 3*b* and thereby favorably minimizing the overall length of housing 1.

Figure 6:
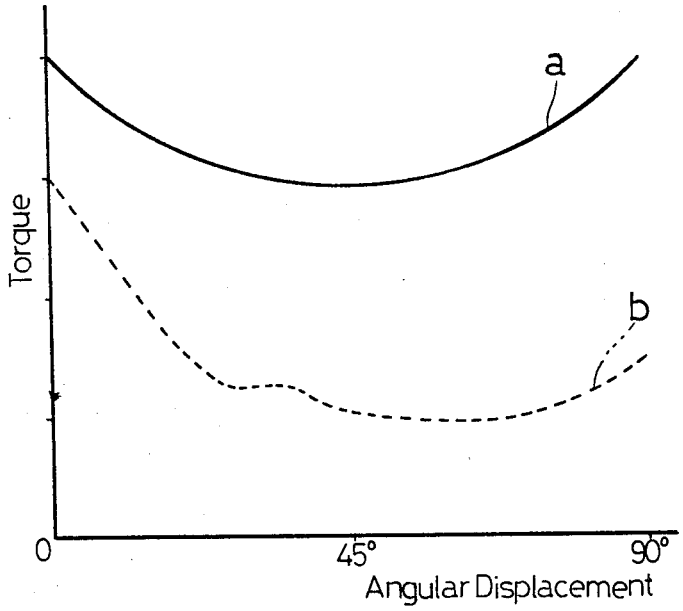
FIG. 6 is a graph showing typical characteristic torque curves with respect to a torque stem of the power cylinder of FIG. 2.
Figure 7:
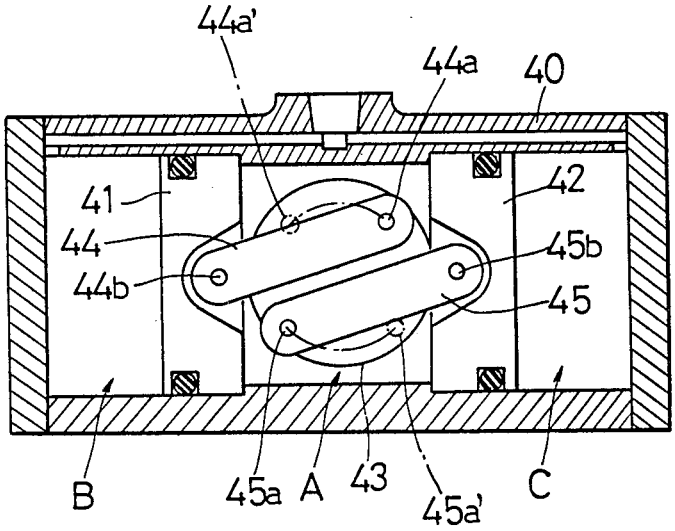
FIG.7 PRIOR ART
FIG. 7 is a horizontal sectional view of a conventional compact rotary power cylinder.

According to the present invention, respective shafts 18, 19 of pistons 2, 3 are secured to associated piston supports 2*b*, 3*b*. Therefore, during the reciprocal motion of pistons 2, 3, respective shafts 18, 19 also move reciprocally, thus correspondingly increasing the distances from the axis of stem 4 to respective acting points of forces applied by pistons 2, 3 to rotate stem 4, particularly when pistons 2, 3 are moving near respective breakaway points. As a result, a substantially improved torque output characteristic curve a is achieved as shown in FIG. 6 for a typical case. This curve a is favorable in consideration of the fact that most final controls in process plants and the like require relatively large breakaway torques as exemplified by a broken torque curve b of FIG. 6.

Moreover, because each piston support 2*b*, 3*b* is regulated from both the inside and outside, each piston 2, 3 is substantially free of backlash and kept stable during the reciprocal motion including respective breakaways.

Although there have been described what are at present considered to be the preferred embodiments of the invention, it will be understood that the present invention may be embodied in other specific forms without departing from the spirit or essential characteristics thereof. The present embodiment is therefore to be considered in all respects as illustrative, and not restrictive. The scope of the invention is indicated by the appended claims rather than by the foregoing description.

I claim:

1. An improvement in a compact rotary power cylinder, including:

a cylinder housing (1);

a torque stem (4) rotatably provided across said housing;

a pair of pistons (2, 3) slidably fitted in said housing either at both sides of said stem;

a first chamber (A) defined by said housing, said stem and both of said pistons;

a pair of second chambers (B, C) each respectively defined by said housing and either of said pistons;

a pair of impact ports ($P_1$, $P_2$) formed in said housing for alternatively supplying and releasing a pressure impact;

said ports communicating one with said first chamber and the other with said second chambers;

interlock means for interlocking said pistons to thereby rotate with said stem; and said interlock means having a pair of slots (15) provided for said stem, a pair of engagement members (18, 19) each respectively loose-fitted in one of said slots, and a pair of fixing members (16, 17) each respectively fixing one of said engagement members to one of said pistons;

comprising:

said slots being radially cut in said stem; and a pair of recesses ($S_1$, $S_2$) each respectively formed in said stem for accommodating therein one of said fixing members.

2. A power cylinder according to claim 1, wherein:

said engagement members comprise a pair of shafts (18, 19);

said fixing members comprise a pair of brackets (16, 17) each respectively supporting either end of one of said shafts; and said recesses are each respectively formed continuous with the corresponding one of said slots.

3. A power cylinder according to claim 2, wherein:

said interlock means has two pairs of said brackets (16, 17; 16, 17);

said stem has two pairs of said recesses ($S_1$, $S_1$; $S_2$, $S_2$) with a pair of fan-like portions (14, 14) respectively defined therebetween; and said slots are respectively cut in said fan-like portions.

4. A power cylinder according to claim 3, wherein:

said two pairs of said recesses are arranged symmetrical with respect to the axis of said stem.

5. A power cylinder according to claim 1, wherein:

said recesses are communicating with each other.

* * * * *